US008330692B2

(12) United States Patent
Tsou et al.

(10) Patent No.: US 8,330,692 B2
(45) Date of Patent: Dec. 11, 2012

(54) DISPLAY PANEL HAVING A PLURALITY OF SWITCHES UTILIZED FOR CONTROLLING THE TIMING OF TURNING ON A SINGLE PIXEL AND DRIVING METHOD THEREOF

(75) Inventors: Yuan-Hsin Tsou, Kaohsiung County (TW); Wen-Hsiung Liu, Pingtung County (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 708 days.

(21) Appl. No.: 12/341,974

(22) Filed: Dec. 22, 2008

(65) Prior Publication Data

US 2009/0160850 A1 Jun. 25, 2009

(30) Foreign Application Priority Data

Dec. 25, 2007 (TW) ..... 96149939 A

(51) Int. Cl.
*G09G 3/36* (2006.01)
*G09G 5/02* (2006.01)

(52) U.S. Cl. ..... 345/92; 345/694

(58) Field of Classification Search ..... 345/92, 345/694

See application file for complete search history.

(56) References Cited

U.S. PATENT DOCUMENTS

| | | | | |
|---|---|---|---|---|
| 6,982,690 | B2 * | 1/2006 | Lee et al. | 345/87 |
| 7,084,842 | B2 * | 8/2006 | Kim et al. | 345/87 |
| 2002/0015110 | A1 * | 2/2002 | Brown Elliott | 345/589 |
| 2006/0022202 | A1 | 2/2006 | Yu et al. | |
| 2008/0024418 | A1 * | 1/2008 | Kim | 345/98 |

* cited by examiner

*Primary Examiner* — Adam J Snyder
(74) *Attorney, Agent, or Firm* — Jianq Chyun IP Office

(57) ABSTRACT

A display panel including a number of data lines and scan lines, a number of first, second, and third switches, and a number of first, second, and third pixels is provided. Each first pixel located at an odd position at a first side of each data line is electrically connected to the corresponding data line through one first switch. Each second pixel located at an even position at the first side of each data line is electrically connected to the corresponding data line through the first, second, and third switches sequentially connected in series. Each third pixel located at a second side of each data line is electrically connected to the corresponding data line through the second and third switches sequentially connected in series. The first, second and third pixels are driven by corresponding scan lines and data lines. A driving method of the display panel is also provided.

15 Claims, 4 Drawing Sheets

DISPLAY PANEL HAVING A PLURALITY OF SWITCHES UTILIZED FOR CONTROLLING THE TIMING OF TURNING ON A SINGLE PIXEL AND DRIVING METHOD THEREOF

CROSS-REFERENCE TO RELATED APPLICATION

This application claims the priority benefit of Taiwan application serial no. 96149939, filed, on Dec. 25, 2007. The entirety of the above-mentioned patent application is hereby incorporated by reference herein and made a part of specification.

BACKGROUND OF THE INVENTION

1. Field of the Invention

The present invention relates to a display panel, and more particularly to a display panel capable of reducing the number of source driver integrated circuits (ICs) and increasing a wiring space of a fan out area and a driving method of said display panel.

2. Description of Related Art

A thin film transistor liquid crystal display (TFT-LCD) characterized by high definition, great space utilization, low power consumption and non-radiation has become a mainstream product in the display market. With an increasing demand for high resolution achieved by the TFT-LCD, more scan lines are required to be disposed on a display panel of the TFT-LCD. Meanwhile, the disposition of more gate driver ICs in a terminal area is also necessitated for providing gate controlling signals. Due to the aforesaid demand, a cost barrier of manufacturing the driver ICs is established.

On the other hand, the gate controlling signals and the scan lines are configured in a one to one manner. Namely, one gate controlling signal is provided by the gate driver IC to drive one corresponding scan line. Therefore, a fan out area connecting gate connectors and the scan lines in a panel tends to become crowded due to the increasing scan lines, thus resulting in an increase in parasitic capacitance or parasitic impedance. Moreover, a layout space assigned for defining the fan out area in the panel must be narrowed down in order to comply with the design demands for lightness, thinness, slimness, and compactness. As such, given that the scan lines in the same number are required to be disposed in the reduced fan out area, the layout circuits should be closely arranged, thus giving rise to the increase in the parasitic capacitance and the parasitic impedance and deteriorating the display quality.

SUMMARY OF THE INVENTION

In light of the foregoing, the present invention is directed to a display panel in which a plurality of switches is utilized for controlling the timing of turning on a single pixel, such that the number of source driver ICs can be reduced, and that a wiring space of a fan out area can be extended.

The present invention is further directed to a driving method by which only a few gate controlling signals are required for manipulating frame display.

To embody the present invention, a display panel including a plurality of data lines, a plurality of scan lines, a plurality of first, second, and third switches, and a plurality of first, second, and third pixels is provided. The data lines and the scan lines are disposed on the display panel. Each of the first pixels is disposed on the display panel and respectively located at an odd position at a first side of each of the data lines. Besides, each of the first pixels is electrically connected to the corresponding data line through one of the first switches. Each of the second pixels is disposed on the display panel and respectively located at an even position at the first side of each of the data lines. Besides, each of the second pixels is electrically connected to the corresponding data line through one first switch, one second switch, and one third switch sequentially connected in series. Each of the third pixels is disposed on the display panel and respectively located at a second side of each of the data lines. Besides, each of the third pixels is electrically connected to the corresponding data line through one second switch and one third switch sequentially connected in series. The first, the second and the third pixels are driven by the corresponding scan lines and data lines.

According to an embodiment of the present invention, the scan lines include a first scan line, a second scan line, and a third scan line. The first scan line is utilized for controlling the first switch of the first pixel and the third switch of the adjacent third pixel at the same time and for controlling the first switch of the second pixel and the third switch of the adjacent third pixel at the same time. The second scan line is used for controlling one of the second switch and the third switch of the third pixel and for controlling the third switch of the second pixel and the third switch of the adjacent third pixel at the same time. The third scan line is utilized for controlling the second switch of the third pixel and for controlling the second switch of the second pixel and the second switch of the adjacent third pixel at the same time.

According to an embodiment of the present invention, the first switch, the second switch, and the third switch of each of the second pixels are sequentially connected in series, an end of the first switch is electrically connected to the second pixel, and an end of the third switch is electrically connected to the data line.

According to an embodiment of the present invention, the second switch and the third switch of each of the third pixels are sequentially connected in series, an end of the third switch is electrically connected to the third pixel, and an end of the second switch is electrically connected to the data line.

According to an embodiment of the present invention, the first switches, the second switches, and the third switches include thin film transistors (TFTs). Each of the TFTs includes a gate, a source, and a drain.

According to an embodiment of the present invention, the display panel includes a liquid crystal display (LCD) panel.

The present invention further provides a driving method suitable for driving said display panel. The display panel includes scan units in the number of N which is a positive integer. The driving method includes following steps. First, a pixel data is written into each of the second pixels respectively located at the even position at the first side of each of the data lines. Next, the pixel data is written into each of the third pixels respectively located at the second side of each of the data lines. Thereafter, the pixel data is written into each of the first pixels respectively located at the odd position at the first side of each of the data lines.

The present invention further provides a driving method suitable for driving said display panel. The display panel includes scan units in the number of N which is a positive integer. The first scan line is electrically connected to a first gate controlling signal. The second scan line is electrically connected to a second gate controlling signal. The third scan line is electrically connected to a third gate controlling signal. The driving method includes following steps. First, the first gate controlling signal, the second gate controlling signal, and the third gate controlling signal are simultaneously enabled, so as to turn on the first switches, the second switches, and the third switches and to further write a pixel data output by the data lines into all of the first, the second, and the third pixels. Next, the third gate controlling signal is disabled, but the first gate controlling signal and the second gate controlling signal are enabled, so as to update the pixel data in the first pixels and in the third pixel located at the uppermost odd position. Thereafter, the second gate controlling signal is disabled but the first gate controlling signal and the third gate controlling signal are enabled, so as to update the pixel data in the first pixel located at an uppermost position and in the third pixel located at the even position. After that, the first gate controlling signal is enabled to update the pixel data in the first pixel located at the uppermost position.

According to another embodiment of the present invention, the pixel data is written into each of the second pixels respectively located at the even position at the first side of each of the data lines in the step of simultaneously enabling the first, the second, and the third gate controlling signals.

According to another embodiment of the present invention, the pixel data is written into each of the third pixels respectively located at the uppermost position at the second side of each of the data lines in the step of disabling the third gate controlling signal but enabling the first gate controlling signal and the second gate controlling signal.

According to another embodiment of the present invention, the pixel data is written into each of the third pixels respectively located at the even position at the second side of each of the data lines in the step of disabling the second gate controlling signal but enabling the first gate controlling signal and the third gate controlling signal.

According to another embodiment of the present invention, the pixel data is written into each of the first pixels respectively located at the uppermost position at the first side of each of the data lines in the step of enabling the first gate controlling signal.

According to another embodiment of the present invention, each of the scan units includes two of the first pixels, the second pixel sandwiched between the two first pixels, and three of the third pixels.

To sum up, in the display panel of the present invention, each of the pixels is equipped with one or more well-arranged switches connected in series. The gate controlling signals are employed to interactively control the scan lines, such that each of the pixels in the display panel is able to control the scan lines at the same time. As such, the pixel data in the individual pixel can be respectively updated. The number of the required source driver ICs can be reduced, and the wiring space of the fan out area is increased, thus resulting in an increase in a design margin of the display panel.

In order to make the aforementioned and other objects, features and advantages of the present invention more comprehensible, several embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
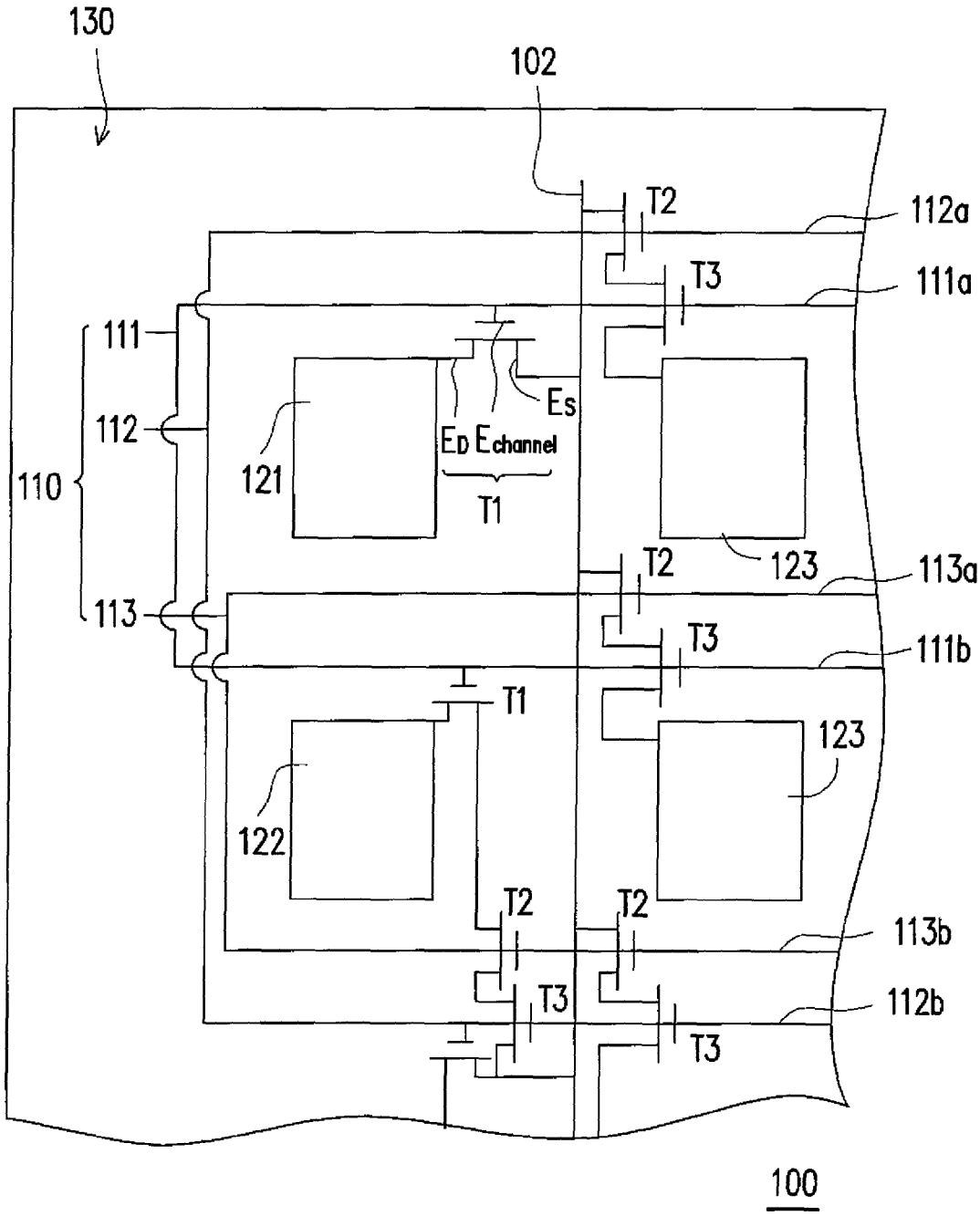
FIG. 1 is a schematic view of a display panel according to an embodiment of the present invention.

FIG. 1 is a schematic view of a display panel according to an embodiment of the present invention. In the present embodiment, a display panel 100 includes a plurality of data lines 102, a plurality of scan lines 110, a plurality of first pixels 121, a plurality of second pixels 122, a plurality of third pixels 123, a plurality of first switches T1, a plurality of second switches T2, and a plurality of third switches T3. Each of said elements is disposed on the display panel 100. Here, only a portion of the display panel 100 is illustrated in the present embodiment for the purpose of better elaboration.

Referring to FIG. 1, each of the first pixels 121 is disposed on the display panel 100 and located at an odd position at a first side (the left side) of one of the data lines 102. Besides, each of the first pixels 121 is electrically connected to the corresponding data line 102 through one of the first switches T1. In the present embodiment, the first switches T1 are, for example, TFTs. In other words, each of the first switches T1 includes a gate $E_{Channel}$, a source $E_S$, and a drain $E_D$. Additionally, the display panel 100 is, for example, an LCD panel.

As shown in FIG. 1, each of the second pixels 122 is disposed on the display panel 100 and located at an even position at the first side of one of the data lines 102. Besides, each of the second pixels 122 is electrically connected to the corresponding data line 102 through one first switch T1, one second switch T2, and one third switch T3 sequentially connected in series. In the present embodiment, the first switches T1, the second switches T2, and the third switches T3 are, for example, the TFTs.

Specifically, the first switch T1, the second switch T2, and the third switch T3 of each of the second pixels 122 are sequentially connected in series. An end of the first switch T1 is electrically connected to the second pixel 122, while an end of the third switch T3 is electrically connected to the data line 102. Namely, when all of the first switches T1, the second switches T2, and the third switches T3 are turned on, pixel data from the data lines 102 are input into the second pixels 122 through the third switches T3, the second switches T2, and the first switches T1 in sequence.

Referring to FIG. 1, each of the third pixels 123 is disposed on the display panel 100 and located at a second side (the right side) of one of the data lines 102. Besides, each of the third pixels 123 is electrically connected to the corresponding data line 102 through one second switch T2 and one third switch T3 sequentially connected in series. In particular, according to the present embodiment, an end of the third switch T3 is electrically connected to the third pixel 123, while an end of the second switch T2 is electrically connected to the data line 102. That is to say, when all of the second switches T2 and the third switches T3 are turned on, the pixel data from the data lines 102 are input into the third pixels 123 through the second switches T2 and the third switches T3 in sequence. Note that the first pixels 121, the second pixels 122, and the third pixels 123 are driven by the corresponding scan lines 110 and data lines 102. In other words, the charge or the discharge of each of the first pixels 121 located at the odd position at the first side of each of the data lines 102 is controlled by one switch, while the charge or the discharge of each of the second pixels 122 located at the even position at the first side of each of the data lines 102 is controlled by three switches. Moreover, the charge or the discharge of each of the third pixels 123 is determined by two switches regardless of whether each of the third pixels 123 is located at the odd position or at the even position.

Referring to FIG. 1, the scan lines 110 include a first scan line 111, a second scan line 112, and a third scan line 113. A first scan line 111*a* is utilized for controlling the first switch T1 of the first pixel 121 and the third switch T3 of the adjacent third pixel 123 at the same time, while a first scan line 111*b* is utilized for controlling the first switch T1 of the second pixel 122 and the third switch T3 of the adjacent third pixel 123 at the same time.

It should be noted that on a terminal area 130 of the display panel 100, the first scan lines 111*a* and 111*b* used for controlling the pixels 121, 122, and 123 are connected to each other, and thereby the two connected first scan lines 111*a* and 111*b* together form the first scan line 111 on the terminal area 130 of the display panel 100, as shown in FIG. 1. As such, not only a wiring layout space between gate connectors and the scan lines in a fan out area of the display panel 100 is increased, but also the parasitic capacitance or the parasitic impedance caused by wiring can be reduced.

The resolution of conventional LCD panel is 1024×768, for example. Notice that, in the above display panel 100 of the present embodiment, the total number of the scan lines 110 disposed in the terminal area 130 of the display panel 100 can be maintained the same (i.e. 768). Moreover, because the pixels 121, 122, 123 at two sides of one data line 102 are driven, the total number of the data lines 102 can be reduced by half (i.e. 512), but the display panel 100 can still achieve the same resolution (i.e 1024).

Likewise, the second scan line 112 is employed to control one of the second switch T2 and the third switch T3 of the third pixel 123. Referring to FIG. 1, according to the present embodiment, a second scan line 112*a* is used for controlling the second switch T2 of the third pixel 123 located at the uppermost position at the second side of the data line 102.

In addition, the second scan line 112*b* is also used for controlling the third switch T3 of the second pixel 122 and the third switch T3 of the adjacent third pixel 123 at the same time. Similar to the first scan line 111, the two second scan lines 112*a* and 112*b* can be connected together for forming the second scan line 112 in the terminal area 130 of the display panel 100. The advantages of the second scan line 112 arranged in said manner resemble those of the first scan line 111, and thus further description in this regard is omitted hereinafter.

Besides, a third scan line 113*a* is utilized for controlling the second switch T2 of the third pixel 123, while a third scan line 113*b* is utilized for controlling the second switch T2 of the second pixel 122 and the second switch T2 of the adjacent third pixel 123 at the same time. Based on the above, the two third scan lines 113*a* and 113*b* can be connected together for forming the third scan line 113 in the terminal area 130 of the display panel 100. Since the advantages of the third scan line 113 arranged in said manner resemble those of the first scan line 111, no further description is provided herein.

The integrated scan lines 110 in the terminal area 130 of the display panel 100 are conducive to effectively driving the display panel 100 by means of only a few gate controlling signals. A driving method of the display panel 100 is described hereinafter.

Figure 2:
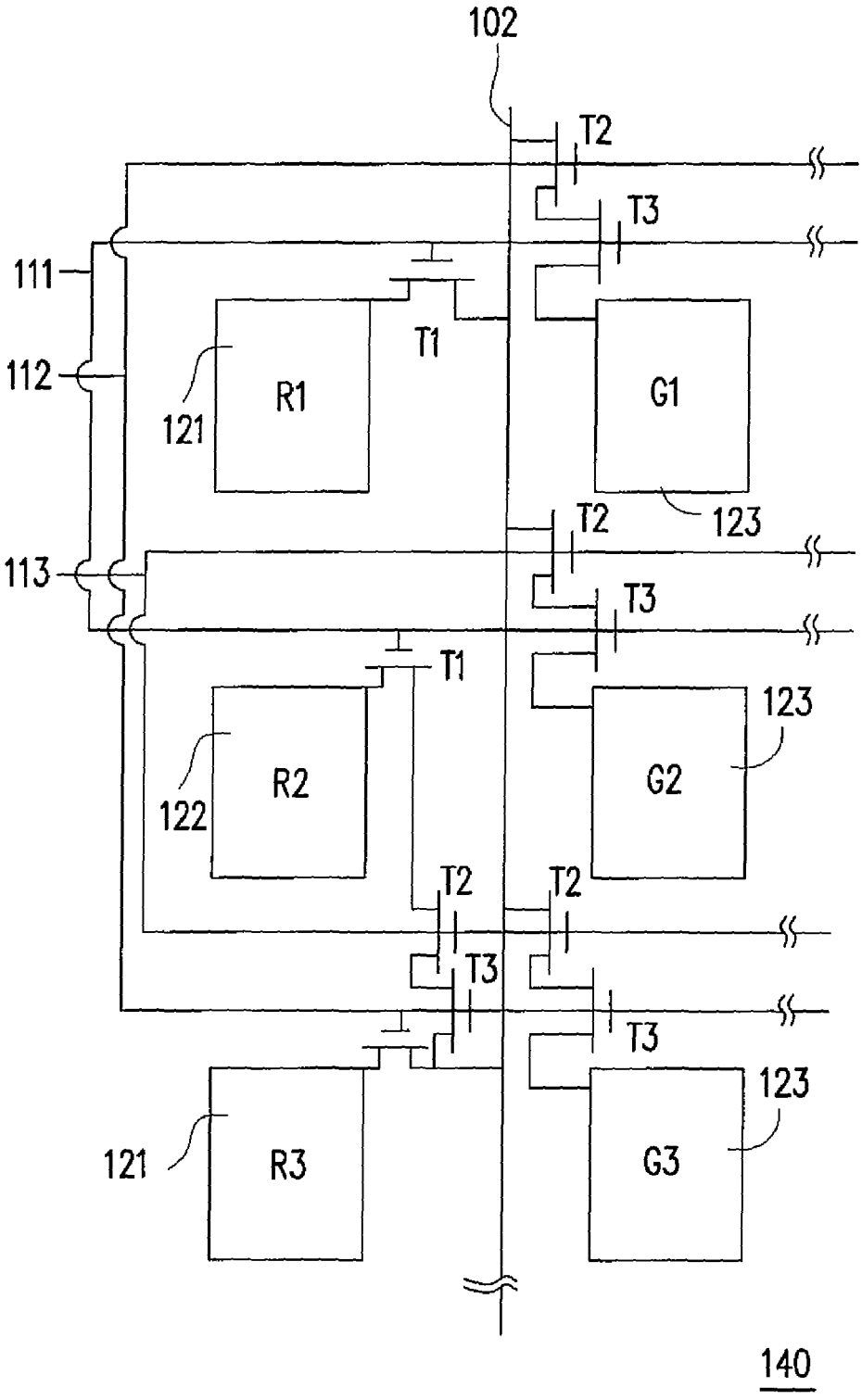
FIG. 2 is a schematic view of a scan unit of the display panel.

FIG. 2 is a schematic view of a scan unit of the display panel. Referring to FIG. 2, the display panel 100 includes scan units 140 in the number of N which is a positive integer. Each of the scan units 140 includes two of the first pixels 121, the second pixel 122 sandwiched between the two first pixels 121, and three of the third pixels 123.

Figure 3:
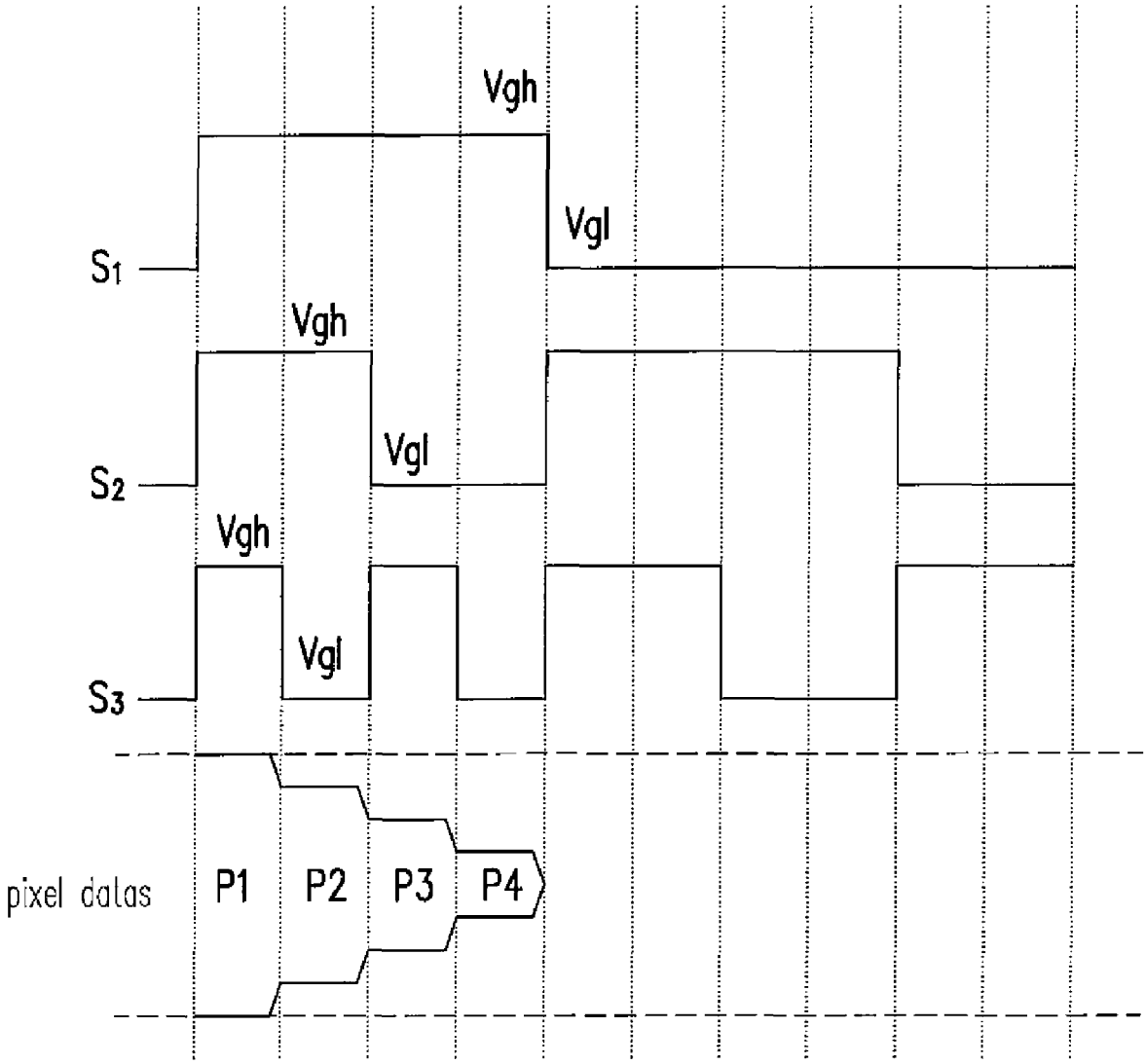
FIG. 3 is a schematic view of a driving waveform according to an embodiment of the present invention.

The driving method includes following steps. First, a pixel data P1 (as illustrated in FIG. 3) is written into each of the second pixels 122 respectively located at the even position at the first side of each of the data lines 102. Thereafter, pixel data P2 and P3 (as illustrated in FIG. 3) are written into each of the third pixels 123 respectively located at the second side of each of the data lines 102. After that, a pixel data P4 (as illustrated in FIG. 3) is written into each of the first pixels 121 respectively located at the odd position at the first side of each of the data lines 102. A driving waveform of the display panel 100 and different display states thereof are provided hereinafter to further elaborate the driving method.

FIG. 3 is a schematic view of a driving waveform according to an embodiment of the present invention. FIGS. 4A through 4D are schematic views illustrating various displaying states of the display panel in different time sequences. Note that the driving waveform illustrated in FIG. 3 is applicable to the scan units 140 provided in FIG. 2. Nevertheless, the present invention poses no limitation on the driving waveform applied to the scan units 140.

Referring to FIGS. 2 and 3 first, the two first pixels 121 of the scan unit 140 include R1 and R3 located at the first side of the data line 102. The second pixel 122 of the scan unit 140 is R2 located at the first side of the data line 102. The three third pixels 123 of the scan unit 140 include G1, G2, and G3 respectively located at the second side of the data line 102. The first scan line 111 is electrically connected to a first gate controlling signal $S_1$. The second scan line 112 is electrically connected to a second gate controlling signal $S_2$. The third scan line 113 is electrically connected to a third gate controlling signal $S_3$.

Normally, the gate controlling signal has two voltage levels $V_{gh}$ and $V_{gl}$. As the voltage level of the gate controlling signal is $V_{gh}$, the switches are turned on by the voltage $V_{gh}$ applied to the scan lines 110. On the contrary, as the voltage level of the gate controlling signal is $V_{gl}$, the switches are turned off by the voltage $V_{gl}$ applied to the scan lines 110.

Figure 4A:
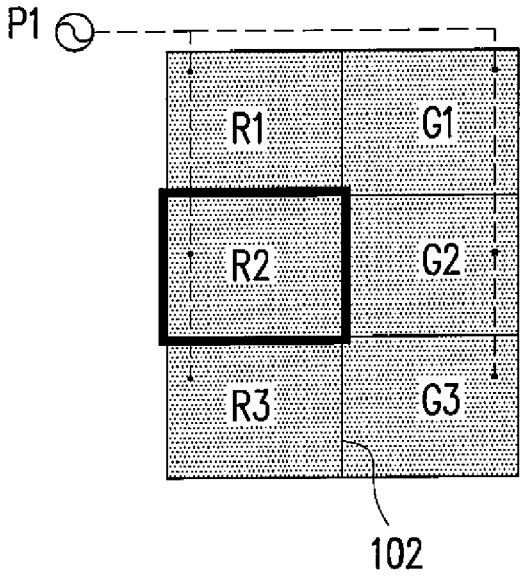
FIGS. 4A through 4D are schematic views illustrating various displaying states of the display panel in different time sequences.

In detail, referring to FIGS. 2, 3, and 4A, the first gate controlling signal $S_1$, the second gate controlling signal $S_2$, and the third gate controlling signal $S_3$ are simultaneously enabled, so as to turn on all of the first switches T1, the second switches T2, and the third switches T3 depicted in FIG. 2. As such, the pixel data P1 output by the data line 102 is written into all of the pixels R1, R2, R3, G1, G2, and G3, and the displaying state of the scan unit 140 at this time is illustrated in FIG. 4A. Specifically, the pixel data P1 is mainly written into the pixel R2 located at the even position at the first side of each of the data lines 102.

Figure 4B:
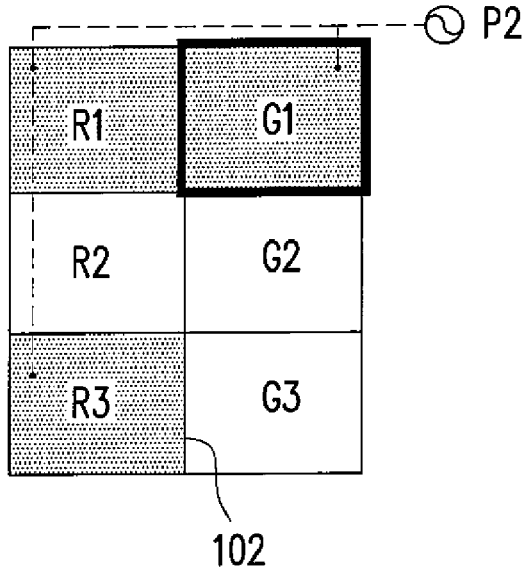

After that, referring to FIGS. 2, 3, and 4B, the third gate controlling signal $S_3$ is disabled, but the first gate controlling signal $S_1$ and the second gate controlling signal $S_2$ are still enabled, so as to update the pixel data P2 in the pixels R1 and G1 depicted in FIG. 2. The displaying state of the scan unit 140 at this time is illustrated in FIG. 4B. Here, the pixel data P2 is mainly written into the pixel G1 located at the uppermost position at the second side of each of the data lines 102.

Figure 4C:
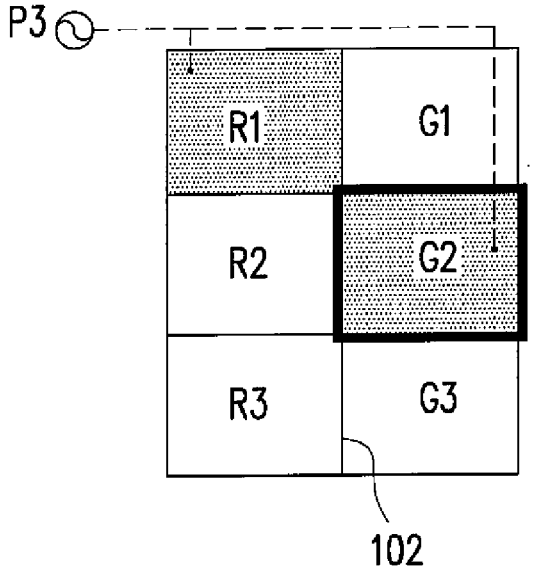

Thereafter, referring to FIGS. 2, 3, and 4C, the second gate controlling signal $S_2$ is disabled, but the third gate controlling signal $S_3$ and the first gate controlling signal $S_1$ are enabled, so as to update the pixel data P3 in the pixel R1 located at the uppermost position and in the third pixel G2 depicted in FIG. 2. The displaying state of the scan unit 140 at this time is illustrated in FIG. 4C. Here, the pixel data P3 is mainly written into the pixel G2 located at the even position at the second side of each of the data lines 102.

Figure 4D:
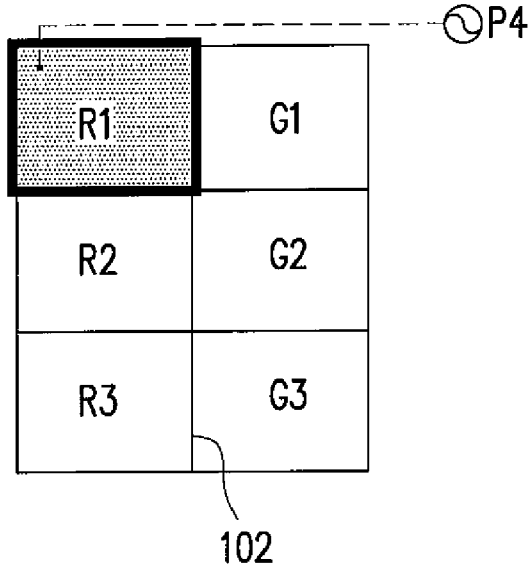

Afterwards, referring to FIGS. 2, 3, and 4D, the first gate controlling signal $S_1$ is enabled again, so as to update the pixel data P4 in the pixel R1 depicted in FIG. 2. The displaying state of the scan unit 140 at this time is illustrated in FIG. 4D. Here, the pixel data P4 is mainly written into the pixel R1 located at the uppermost position at the first side of each of the data lines 102. The pixel data P1, P2, P3, and P4 are different from one another, and the value of each of the pixel data P1, P2, P3, and P4 is not limited in the present invention.

In brief, according to the aforesaid driving method, the time sequence of turning on or turning off the gate controlling signals $S_1$, $S_2$, and $S_3$ in each of the scan units 140 is determined, such that the first switches T1, the second switches T2, and the third switches T3 can be turned on at different times. Thereby, the pixel data output from each of the data lines 102 can be written into the designated pixels in time sequence.

As illustrated in FIGS. 4A-4D, after all of the pixel data are sequentially written into the pixels of each of the scan units 140 located at different rows, a display frame is completed. After that, the pixel data are again written into the scan units 140 in said manner for displaying next frame.

Likewise, the number of the terminal area of the panel at the side of disposing the source driver ICs can be reduced, so as to decrease the number of the data lines, to increase the wiring space of the fan out area of the source driver ICs, and to reduce the parasitic capacitance arisen from the excessive scan lines.

To sum up, the display panel and the driving method thereof in the present invention are characterized by the following advantages The display panel of the present invention contributes to a reduction of the number of the data lines in the terminal area of the display panel. Thereby, the required wiring layout space in the fan out area can be increased, and the design margin of the display panel can also be improved.

Since the display panel of the present invention can be driven by means of only a few data lines, the unwanted parasitic capacitance and the parasitic impedance arisen from the excessive wiring in the terminal area of the display panel can be reduced, and thereby the display quality is promoted.

According to the driving method, the design of the driving circuit is simplified, and the manufacturing costs can be lowered down. Moreover, the number of the source driver ICs is also decreased, such that the cost barrier of manufacturing the source driver ICs is removed.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A display panel, comprising:

a plurality of data lines, disposed on the display panel;

a plurality of first switches;

a plurality of second switches;

a plurality of third switches, wherein the first switches, the second switches, and the third switches are disposed on the display panel;

a plurality of first pixels, disposed on the display panel and each of the first pixels being located at an odd position at a first side of each of the data lines, each of the first pixels being electrically connected to the corresponding data line through one of the first switches;

a plurality of second pixels, disposed on the display panel and each of the second pixels being located at an even position at the first side of each of the data lines, each of the second pixels being electrically connected to the corresponding data line through one first switch, one second switch, and one third switch sequentially connected in series, wherein the second pixels and the first pixels located at the first side of the same data line are arranged alternately along the data line and aligned with one another;

a plurality of third pixels, disposed on the display panel and the third pixels being respectively located at each even position and each odd position at a second side of each of the data lines, each of the third pixels being electrically connected to the corresponding data line through one second switch and one third switch sequentially connected in series; and a plurality of scan lines, disposed on the display panel, wherein the first pixels, the second pixels, and the third pixels are driven by the scan lines and the data lines.

2. The display panel as claimed in claim 1, wherein the scan lines comprise:

a first scan line, for controlling the first switch of the first pixel and the third switch of the adjacent third pixel at the same time and for controlling the first switch of the second pixel and the third switch of the adjacent third pixel at the same time;

a second scan line, for controlling one of the second switch and the third switch of the third pixel and for controlling the third switch of the second pixel and the third switch of the adjacent third pixel at the same time; and a third scan line, for controlling the second switch of the third pixel and for controlling the second switch of the second pixel and the second switch of the adjacent third pixel at the same time.

3. A driving method, suitable for driving the display panel as claimed in claim 2, the display panel comprising scan units in the number of N which is a positive integer, the first scan line being electrically connected to a first gate controlling signal, the second scan line being electrically connected to a second gate controlling signal, the third scan line being electrically comlected to a third gate controlling signal, the driving method comprising:

(A) simultaneously enabling the first gate controlling signal, the second gate controlling signal, and the third gate controlling signal, so as to turn on the first switches, the second switches, and the third switches and to further write a pixel data output by the data lines into all of the first, the second, and the third pixels;

(B) disabling the third gate controlling signal but enabling the first gate controlling signal and the second gate controlling signal, so as to update the pixel data in the first pixels and in the third pixel located at the uppermost odd position;

(C) disabling the second gate controlling signal but enabling the first gate controlling signal and the third gate controlling signal, so as to update the pixel data in the first pixel located at an uppermost position and in the third pixel located at the even position; and (D) enabling the first gate controlling signal to update the pixel data in the first pixel located at the uppermost position.

4. The driving method as claimed in claim 3, wherein the pixel data is written into each of the second pixels respectively located at the even position at the first side of each of the data lines in the step (A).

5. The driving method as claimed in claim 3, wherein the pixel data is written into each of the third pixels respectively located at the uppermost position at the second side of each of the data lines in the step (B).

6. The driving method as claimed in claim 3, wherein the pixel data is written into each of the third pixels respectively located at the even position at the second side of each of the data lines in the step (C).

7. The driving method as claimed in claim 3, wherein the pixel data is written into each of the first pixels respectively located at the uppermost position at the first side of each of the data lines in the step (D).

8. The driving method as claimed in claim 3, wherein each of the scan units comprises:

two of the first pixels;

the second pixel sandwiched between the two first pixels; and three of the third pixels.

9. The display panel as claimed in claim 1, wherein the first switch, the second switch, and the third switch of each of the second pixels are sequentially connected in series, an end of the first switch is electrically connected to the second pixel, and an end of the third switch is electrically connected to the data line.

10. The display panel as claimed in claim 1, wherein the second switch and the third switch of each of the third pixels are sequentially connected in series, an end of the third switch is electrically connected to the third pixel, and an end of the second switch is electrically connected to the data line.

11. The display panel as claimed in claim 1, wherein the first switches, the second switches, and the third switches comprise thin film transistors.

12. The display panel as claimed in claim 11, wherein each of the thin film transistors comprises a gate, a source, and a drain.

13. The display panel as claimed in claim 1, wherein the display panel comprises a liquid crystal display panel.

14. A driving method, suitable for driving the display panel as claimed in claim 1, the display panel comprising scan units in the number of N which is a positive integer, the driving method comprising:

writing a pixel data into each of the second pixels respectively located at the even position at the first side of each of the data lines;

writing the pixel data into each of the third pixels respectively located at the second side of each of the data lines; and writing the pixel data into each of the first pixels respectively located at the odd position at the first side of each of the data lines.

15. The driving method as claimed in claim 14, wherein each of the scan units comprises:

two of the first pixels;

the second pixel sandwiched between the two first pixels; and three of the third pixels.

* * * * *